US009545986B2

(12) United States Patent
Kadobayashi

(10) Patent No.: US 9,545,986 B2
(45) Date of Patent: Jan. 17, 2017

(54) BOAT PROPULSION DEVICE

(71) Applicant: YAMAHA HATSUDOKI KABUSHIKI KAISHA, Iwata-shi, Shizuoka (JP)

(72) Inventor: Yoshiyuki Kadobayashi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 78 days.

(21) Appl. No.: 14/748,785

(22) Filed: Jun. 24, 2015

(65) Prior Publication Data

US 2016/0039512 A1 Feb. 11, 2016

(30) Foreign Application Priority Data

Aug. 8, 2014 (JP) ..... 2014-163162

(51) Int. Cl.

| | |
|---|---|
| ***B63H 21/38*** | (2006.01) |
| ***B63H 20/32*** | (2006.01) |
| ***B63H 20/00*** | (2006.01) |
| *G06F 19/00* | (2011.01) |
| *F02D 41/14* | (2006.01) |

(52) U.S. Cl.

CPC ..... *B63H 20/32* (2013.01); *B63H 20/001* (2013.01)

(58) Field of Classification Search

CPC ..... B63H 21/14; B63H 21/22; B63H 21/38; B63H 20/32; B63H 20/001; B63H 20/00

See application file for complete search history.

(56) References Cited

U.S. PATENT DOCUMENTS

| | | | | |
|---|---|---|---|---|
| 7,798,872 | B2 * | 9/2010 | Fujino | B63H 21/14 440/1 |
| 2011/0223819 | A1 | 9/2011 | Kazuta | |
| 2014/0026862 | A1 | 1/2014 | Nakayama et al. | |

FOREIGN PATENT DOCUMENTS

| | | | |
|---|---|---|---|
| JP | 2011-190704 | A | 9/2011 |
| JP | 2014-020354 | A | 2/2014 |

* cited by examiner

*Primary Examiner* — Hieu T Vo

(74) *Attorney, Agent, or Firm* — Keating and Bennett, LLP

(57) ABSTRACT

A boat propulsion device includes an engine, a fuel tank, a fuel path, a fuel pump, and a controller. The engine includes a fuel injection device. The fuel tank includes a fuel storage region configured to store fuel. The fuel path is connected to the fuel injection device and the fuel tank. The fuel pump is disposed in the fuel path and is configured to discharge the fuel stored in the fuel storage region to the fuel injection device. The controller is configured and/or programmed to control a load on the fuel pump. The controller is configured and/or programmed to include an empty-fuel condition detector configured to detect that the fuel stored in the fuel storage region has become a predetermined remaining amount or less based on a variation in the load on the fuel pump.

9 Claims, 13 Drawing Sheets

BOAT PROPULSION DEVICE

CROSS-REFERENCE TO RELATED APPLICATIONS

This application claims priority under 35 U.S.C. §119 to Japanese Patent Application No. 2014-163162, filed on Aug. 8, 2014. The entire disclosure of Japanese Patent Application No. 2014-163162 is hereby incorporated herein by reference.

BACKGROUND OF THE INVENTION

1. Field of the Invention

The present invention relates to a boat propulsion device equipped with a fuel tank.

2. Description of the Related Art

A boat propulsion device, equipped with a fuel tank, an engine, and an exhaust pipe, is well-known (see e.g., Japan Laid-open Patent Application Publication No. JP-A-2011-190704). The fuel tank temporarily stores fuel from an outside tank disposed in a hull. The engine includes a fuel injection device that injects the fuel stored in the fuel tank into cylinders. The exhaust pipe is connected to the engine and accommodates a catalyst. When the fuel tank runs out of fuel in the boat propulsion device, chances are that an air-fuel ratio in the cylinders becomes an over-lean state and misfiring occurs. In this case, chances are that unburnt gas, leaking out of the engine into the exhaust pipe, burns by making contact with the catalyst heated to a high temperature, and thus, the high-temperature catalyst is overheated.

In view of the above, Japan Laid-open Patent Application Publication No. JP-A-2014-20354 discloses a technology for a boat propulsion device which is configured to preliminarily detect a fuel shortage in a fuel tank based on a decrease in pressure of the fuel to be supplied to the fuel tank.

However, the boat propulsion device disclosed in Japan Laid-open Patent Application Publication No. JP-A-2014-20354 is required to be equipped with a fuel pressure sensor to detect the pressure of the fuel.

SUMMARY OF THE INVENTION

A boat propulsion device according to a preferred embodiment of the present invention includes an engine, a fuel tank, a fuel path, a fuel pump, and a controller. The engine includes a fuel injection device. The fuel tank includes a fuel storage region configured to store fuel. The fuel path is connected to the fuel injection device and the fuel tank. The fuel pump is disposed in the fuel path and is configured to discharge the fuel stored in the fuel storage region to the fuel injection device. The controller is configured and/or programmed to control a load on the fuel pump. The controller is configured and/or programmed to include an empty-fuel condition detector configured to detect that the fuel stored in the fuel storage region has become a predetermined remaining amount or less based on a variation in the load on the fuel pump.

In the boat propulsion device according to a preferred embodiment of the present invention, the controller is configured and/or programmed to detect a fuel shortage (a so-called an empty-fuel condition) in the fuel tank based on a variation in the load on the fuel pump. Thus, unlike a well-known boat propulsion device, the boat propulsion device according to a preferred embodiment of the present invention is not required to be equipped with a device exclusively to detect a fuel shortage (e.g., a fuel pressure sensor). Hence, the boat propulsion device according to a preferred embodiment of the present invention detects a fuel shortage with a simple structure.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A structure of a boat propulsion device to which fuel supply devices according to preferred embodiments is applied will be hereinafter explained with reference to the attached drawings. It should be noted that the fuel supply devices according to the present preferred embodiments are also applicable to an automobile, a motorcycle and other vehicles equipped with an engine (internal combustion).

First Preferred Embodiment

Figure 1:
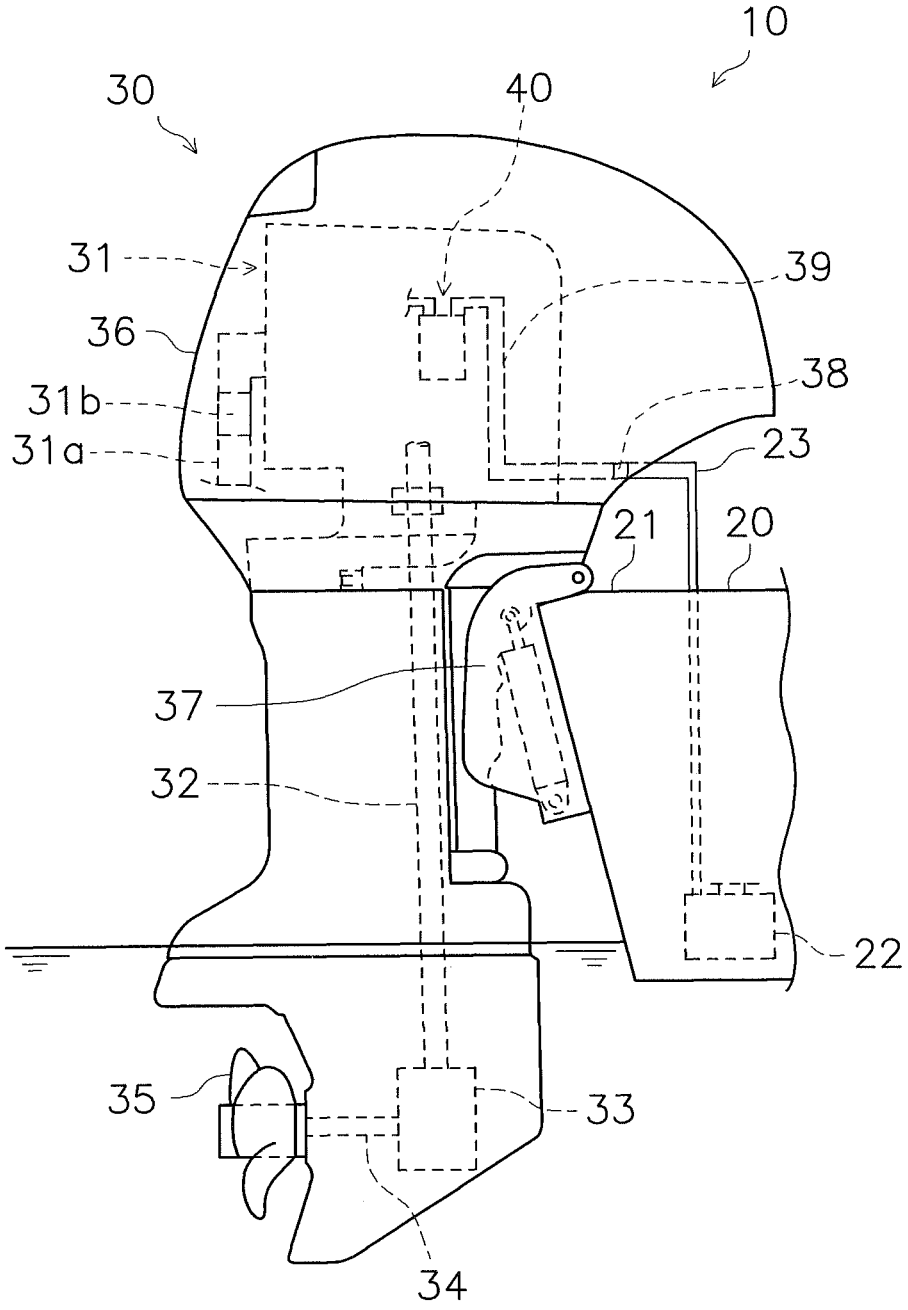
FIG. 1 is a side view of a structure of a rear end portion and the periphery thereof in a water vehicle.

FIG. 1 is a side view of a structure of a rear end portion and the periphery thereof in a water vehicle 10. The water vehicle 10 includes a hull 20 and an outboard motor 30 as a boat propulsion device.

The hull 20 includes a transom 21, an outside tank 22, and an outside hose 23. The outboard motor 30 is fixed to the transom 21. The outside tank 22 stores fuel to be supplied to the outboard motor 30. The outside hose 23 is connected to the outside tank 22 and the outboard motor 30. The fuel stored in the outside tank 22 is supplied to the outboard motor 30 through the outside hose 23.

The outboard motor 30 includes an engine 31, a drive shaft 32, a shift mechanism 33, a propeller shaft 34, a propeller 35, a cowling 36, a bracket 37, a hose connector 38, a fuel supply pipe 39, and a fuel supply device 40.

The engine 31 is an internal combustion configured to generate a driving force by burning the fuel. The engine 31 includes an exhaust pipe 31*a* and a catalyst 31*b*. The exhaust pipe 31*a* is connected to an exhaust path (not shown in the drawings). The catalyst 31*b* is accommodated in the exhaust pipe 31*a*. The drive shaft 32 is coupled to the engine 31 and is configured to be rotated by the driving force of the engine 31.

The shift mechanism 33 is disposed between the drive shaft 32 and the propeller shaft 34. The shift mechanism 33 is movable among a forward thrust position, a neutral position, and a rearward thrust position. The shift mechanism 33 is configured to switch the rotation of the propeller shaft 34 among a forward thrust state, an unmoved state, and a rearward thrust state. The propeller 35 is attached to the rear end of the propeller shaft 34.

The cowling 36 accommodates the engine 31, the fuel supply device 40 and so forth. The bracket 37 is attached to the transom 21 of the hull 20. The outboard motor 30 is supported by the bracket 37 so as to be pivotable in the right-and-left direction and the up-and-down direction.

The hose connector 38 is attached to the cowling 36. The tip of the outside hose 23 is connected to the hose connector 38. The fuel supply pipe 39 is connected to the hose connector 38 and the fuel supply device 40. The fuel, fed from the outside hose 23, is supplied to the fuel supply device 40 through the fuel supply pipe 39. The fuel supply device 40 is connected to the fuel supply pipe 39 and the engine 31. The fuel supply device 40 is configured to supply the fuel fed thereto from the fuel supply pipe 39 to the engine 31.

Figure 2:
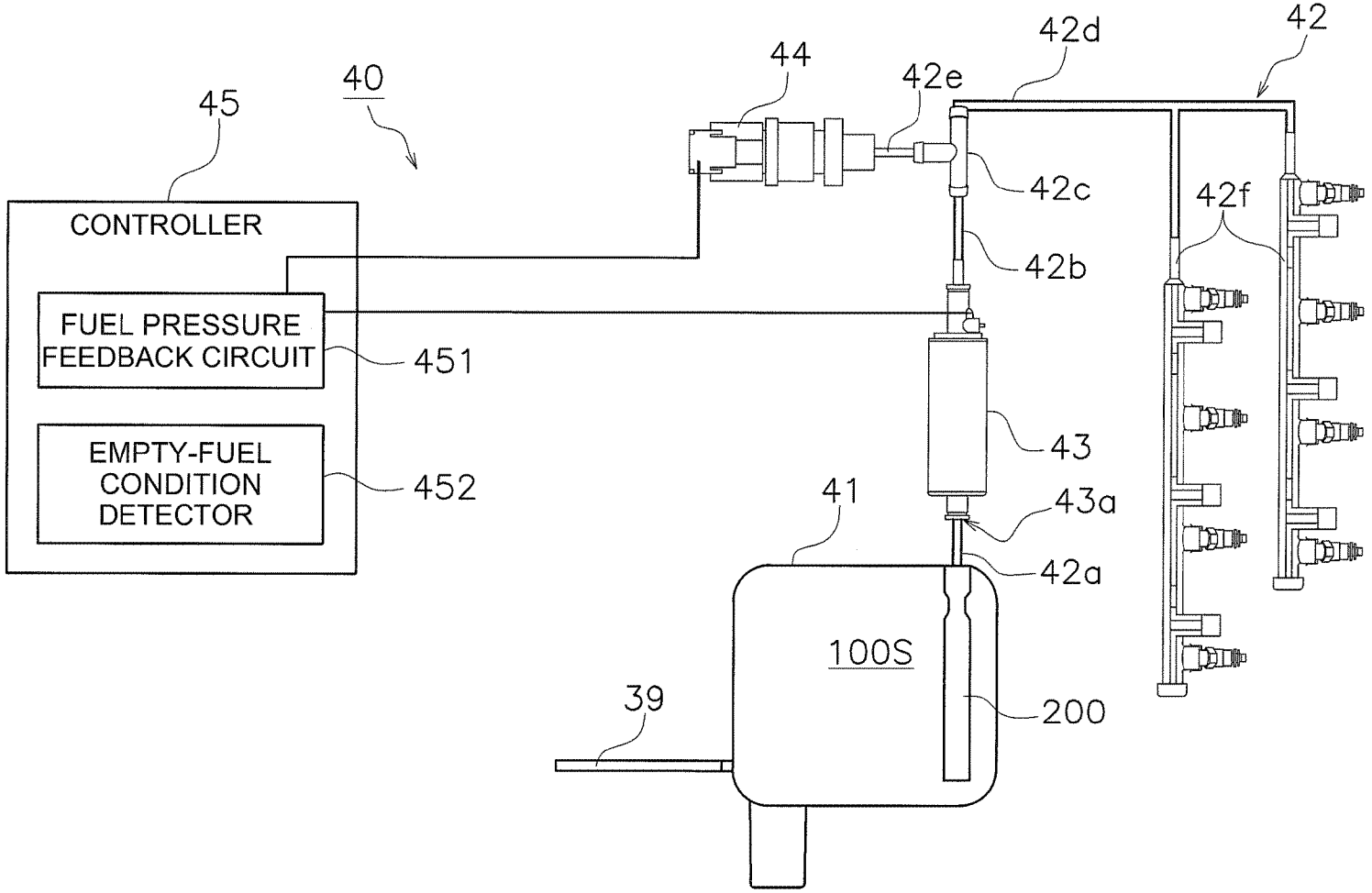
FIG. 2 is a schematic diagram of a structure of a fuel supply device according to a first preferred embodiment of the present invention.

Next, a structure of the fuel supply device 40 will be explained. FIG. 2 is a schematic diagram of the structure of the fuel supply device 40 according to the first preferred embodiment.

The fuel supply device 40 includes a fuel tank 41, a fuel path 42, a fuel pump 43, a fuel pressure sensor 44, and a controller 45.

The fuel tank 41 includes a fuel storage region 100S configured to store the fuel fed thereto through the fuel supply pipe 39. The fuel storage region 100S is a sealed region with liquid tight properties and gas tight properties. In the fuel storage region 100S, the fuel in a gaseous state (hereinafter referred to as "a vaporized fuel") is produced as a result of vaporization of the fuel in a liquid state (hereinafter referred to as "vaporized fuel"). Thus, the fuel storage region 100S stores both of the liquid fuel and the vaporized fuel in a sealed condition. The structure of the fuel tank 41 will be described below.

The fuel path 42 is connected to the fuel tank 41 and the engine 31 (see FIG. 1). The fuel path 42 includes a first fuel hose 42*a*, a second fuel hose 42*b*, a branch pipe 42*c*, a third fuel hose 42*d*, a fourth fuel hose 42*e*, and a fuel injection device 42*f*.

The first fuel hose 42*a* is connected to the fuel tank 41 and the fuel pump 43. The first fuel hose 42*a* includes a vaporized-liquid fuel mixture suction portion 200 disposed within the fuel storage region 100S of the fuel tank 41. The vaporized-liquid fuel mixture suction portion 200 is configured to suck a mixture of the liquid fuel and the vaporized fuel (hereinafter referred to as "vaporized-liquid fuel mixture") stored in the fuel storage region 100S. The structure of the vaporized-liquid fuel mixture suction portion 200 will be described below.

The second fuel hose 42*b* is connected to the fuel pump 43 and the branch pipe 42*c*. The third fuel hose 42*d* is connected to the branch pipe 42*c* and the fuel injection device 42*f*. The fourth fuel hose 42*e* is connected to the branch pipe 42*c* and the fuel pressure sensor 44. The fuel injection device 42*f* is attached to an intake system of the engine 31.

The fuel pump 43 is disposed in the fuel path 42. The fuel pump 43 is disposed between the first fuel hose 42*a* and the second fuel hose 42*b*. The fuel pump 43 is configured to produce negative pressure in a pump suction port 43*a*. When the fuel pump 43 is driven and the negative pressure is produced in the pump suction port 43*a*, the vaporized-liquid fuel mixture produced in the vaporized-liquid fuel mixture suction portion 200 is sucked into the fuel pump 43 and a liquid fuel is drawn into the fuel storage region 100S. This is because the fuel storage region 100S is a sealed region. Thus, the vaporized fuel is efficiently sucked out of the fuel storage region 100S. The fuel storage region 100S is thus prevented from completely running out of the liquid fuel even after a dead soak. Therefore, the fuel pump 43 continuously exerts its pump action, and an oil-film seal is maintained inside the fuel pump 43. As a result, the liquid fuel is quickly drawn into the fuel tank 41. Further, the fuel tank 41 is compact due to the advantageous effect of preventing the fuel storage region 100S from running out of the liquid fuel.

The fuel pump 43 is configured to suck the vaporized-liquid fuel mixture through the first fuel hose 42*a*. The fuel pump 43 is configured to produce a discharge pressure greater than or equal to a pressure at which the vaporized fuel contained in the vaporized-liquid fuel mixture liquefies. The discharge pressure of the fuel pump 43 is a pressure obtained by adding a surplus pressure, which is greater than or equal to a Reid vapor pressure exerted at about 37.8 degrees Celsius, for example, to the maximum target fuel pressure (e.g., about 300 kPa) to reliably cause the fuel injection device 42*f* to inject a required amount of the fuel with a fully opened throttle valve. The surplus pressure is preferably greater than or equal to the vapor pressure of the fuel in the fuel path 42 over the entire temperature range in an actual usage environment of the fuel supply device 40. The suction amount per unit time of the fuel pump 43 is preferably greater than the amount of the vaporized-liquid fuel mixture (i.e., sum of the liquid fuel and the vaporized fuel) to be sucked per unit time.

The fuel pump 43 is configured to compress and liquefy the vaporized fuel contained in the vaporized-liquid fuel mixture and then discharge the liquefied fuel to the second fuel hose 42*b*. A trochoid pump, for example, compatible with a PWM (Pulse Width Modulation) control is preferably used as the fuel pump 43.

The fuel pressure sensor 44 is connected to the fourth fuel hose 42*e*. The fuel pressure sensor 44 is configured to detect the pressure of the fuel in the fuel path 42, i.e., the discharge pressure of the fuel pump 43. The fuel pressure sensor 44 is configured to output a detection value to the controller 45.

The controller 45 is configured and/or programmed to include a fuel pressure feedback circuit 451 and an empty-fuel condition detector 452.

Figure 3:
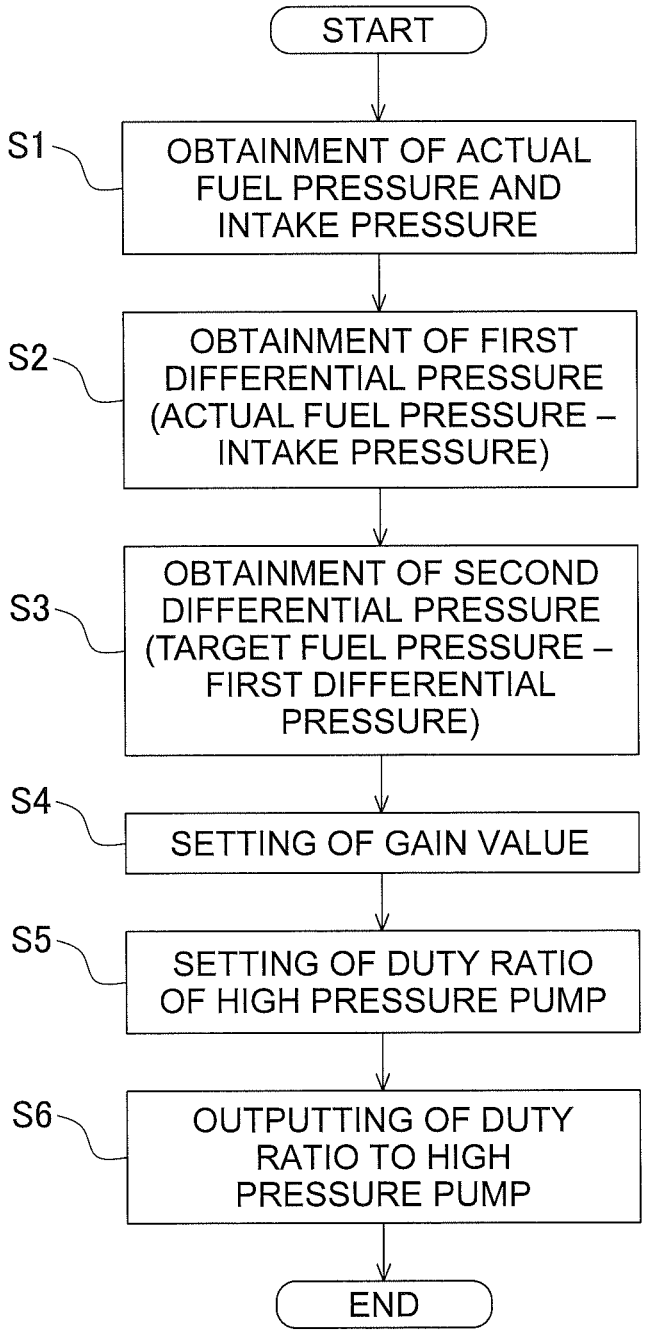
FIG. 3 is a flowchart for explaining a fuel pressure feedback control.

The fuel pressure feedback circuit 451 is configured to perform a fuel pressure feedback control to cause a variation in the discharge pressure of the fuel pump 43 based on a detection value of the actual fuel pressure detected by the fuel pressure sensor 44. FIG. 3 is a flowchart for explaining the fuel pressure feedback control performed by the fuel pressure feedback circuit 451.

In Step S1, the fuel pressure feedback circuit 451 obtains the actual fuel pressure in the fuel path 42 from the fuel pressure sensor 44 and also obtains the intake pressure from an intake pressure sensor (not shown in the drawings) attached to the intake system of the engine 31. Next in Step S2, the fuel pressure feedback circuit 451 calculates a value (a first differential pressure) by subtracting the intake pressure from the actual fuel pressure. Next in Step S3, the fuel pressure feedback circuit 451 calculates a value (a second differential pressure) by subtracting the first differential pressure from a preliminarily set target fuel pressure. The target fuel pressure is a fuel pressure required to reliably cause the fuel injection device 42*f* to inject a required amount of the fuel, and is preferably set based on the rotation speed of the engine 31 and the intake pressure.

Next in Step S4, the fuel pressure feedback circuit 451 sets a gain value to modify the discharge pressure of the fuel pump 43 based on the second differential pressure. Next in Step S5, the fuel pressure feedback circuit 451 sets a duty ratio of the fuel pump 43 based on the gain value. The duty ratio of the fuel pump 43 corresponds to the load on the fuel pump 43. An increase or decrease in duty ratio indicates a variation in the load on the fuel pump 43. Next in Step S6, the fuel pressure feedback circuit 451 controls the discharge pressure of the fuel pump 43 by outputting the duty ratio to the fuel pump 43. When a sufficient amount of the fuel is reliably stored in the fuel storage region 100S, the actual fuel pressure varies within a slight increase/decrease range. Thus, the fuel pressure feedback circuit 451 maintains the actual fuel pressure substantially constant by slightly increasing or decreasing the duty ratio. Contrarily, when the amount of the fuel stored in the fuel storage region 100S is reduced, the actual fuel pressure is remarkably decreased by sucking the vaporized fuel in the fuel storage region 100S. Thus, to maintain the actual fuel pressure constant, the fuel pressure feedback circuit 451 controls and remarkably increases the duty ratio.

Figure 4:
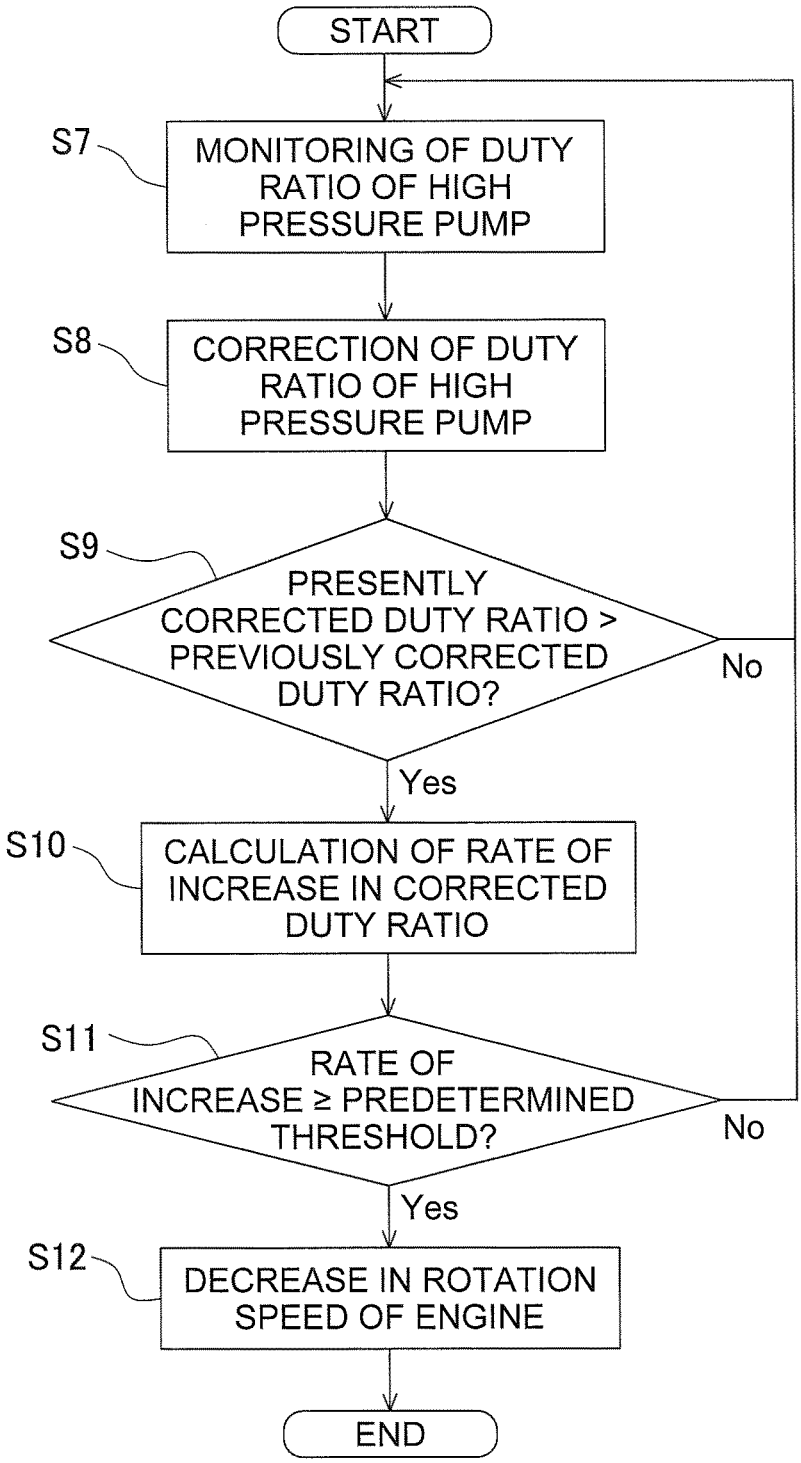
FIG. 4 is a flowchart for explaining an empty-fuel condition control.

Along with the aforementioned fuel pressure feedback control to be performed by the fuel pressure feedback circuit 451, the empty-fuel condition detector 452 performs an empty-fuel condition control to reduce the rotation speed of the engine 31 when detecting a fuel shortage (a so-called an empty-fuel condition) in the fuel storage region 100S. FIG. 4 is a flowchart for explaining the empty-fuel condition control to be performed by the empty-fuel condition detector 452.

First in Step S7, the empty-fuel condition detector 452 monitors the duty ratio of the fuel pump 43 set by the fuel pressure feedback circuit 451 at predetermined time intervals. It is possible to detect a time-series variation in the duty ratio outputted in Step S6 by monitoring the duty ratio at predetermined time intervals.

Next in Step S8, the empty-fuel condition detector 452 calculates a corrected duty ratio by correcting the duty ratio based on a variation in power source voltage, variation in fuel temperature, or variation in fuel flow rate. The power source voltage is an effective voltage to be applied to the fuel pump 43. The fuel temperature is an intake temperature, an estimated fuel temperature estimated based on the wall temperature of the engine 31, or an actually measured temperature of the fuel discharged from the fuel pump 43. The fuel flow rate is an amount of the fuel required for injecting the fuel from the fuel injection device 42*f*, and is a theoretical value defined based on the rotation speed of the engine 31. When the power source voltage or the fuel temperature decreases, the fuel pressure feedback circuit 451 is configured to increase the duty ratio of the fuel pump 43 in accordance with the decrease. Therefore, the empty-fuel condition detector 452 decreases the amount of duty ratio increased in accordance with a decrease in the power source voltage or a decrease in the fuel temperature by subtracting, from the duty ratio, an amount of increase in duty ratio to be estimated based on the amount of decrease in power source voltage or decrease in fuel temperature. On the other hand, when the fuel flow rate (the theoretical value) decreases in accordance with a decrease in the rotation speed of the engine 31, the fuel pressure feedback circuit 451 is configured to decrease the duty ratio of the fuel pump 43 in accordance with the decrease. Therefore, the empty-fuel condition detector 452 adjusts the amount of duty ratio decreased in accordance with a decrease in the fuel flow rate by adding, to the duty ratio, an amount of decrease in duty ratio to be estimated based on the decrease in fuel flow rate. By thus cancelling out the increase or decrease in duty ratio in accordance with a variation in the power source voltage, variation in fuel temperature, or variation in fuel flow rate, it is possible to eliminate factors other than an increase or decrease in the storage amount in the fuel storage region 100S as noise, and thus, accurately observe a variation in duty ratio in accordance with an increase or decrease in the storage amount in the fuel storage region 100S.

Next in Step S9, the empty-fuel condition detector 452 determines whether or not the corrected duty ratio calculated presently is greater than that calculated previously. The fact that the corrected duty ratio calculated presently is greater than that calculated previously indicates that there is a possibility of a decrease in the amount of the fuel stored in the fuel storage region 100S. When the empty-fuel condition detector 452 determines that the corrected duty ratio calculated presently is greater than that calculated previously, the process proceeds to Step S10, and otherwise, returns to Step S7.

Next in Step S10, the empty-fuel condition detector 452 calculates a rate of increase in the corrected duty ratio by differentiating a differential obtained by subtracting the corrected duty ratio calculated previously from that calculated presently. The rate of increase in the corrected duty ratio is a rate of increase in duty ratio per unit time.

Next in Step S11, the empty-fuel condition detector 452 determines whether or not the rate of increase in the corrected duty ratio is greater than or equal to a predetermined threshold. During this process, the empty-fuel condition detector 452 determines whether or not the storage amount in the fuel storage region 100S has become a predetermined remaining amount or less, i.e., whether or not an empty-fuel condition has occurred. When determining that the rate of increase is greater than or equal to the predetermined threshold, the empty-fuel condition detector 452 determines that the empty-fuel condition has occurred. Accordingly, the process proceeds to Step S12. The predetermined remaining amount is only required to be set to an amount that enables the engine 31 to be driven until the temperature of the catalyst 31*b* decreases and becomes less than the ignition temperature of the fuel. When determining that the rate of increase is less than the predetermined threshold, the empty-fuel condition detector 452 determines that the empty-fuel condition has not occurred. Accordingly, the process returns to Step S7.

Next in Step S12, the empty-fuel condition detector 452 decreases the rotation speed of the engine 31 in order to decrease the temperature of the catalyst 31*b* accommodated in the exhaust pipe 31*a*. For example, various methods are possible to decrease the rotation speed of the engine 31, including a method of reducing the fuel injection amount of the fuel injection device 42*f* and a method of decreasing the opening degree of the throttle valve of the engine 31.

As described above, the empty-fuel condition control is performed with the use of the fuel pressure sensor 44 that is also used for the fuel pressure feedback control. Hence, it is not required to additionally provide a device exclusively to detect the empty-fuel condition (e.g., a fuel pressure sensor). Thus, fuel shortage is detected with a simple structure. Further, it is possible to decrease the temperature of the catalyst 31*b* to be less than the ignition temperature of the fuel by the aforementioned empty-fuel condition control. It is thus possible to inhibit an occurrence of a situation that the fuel, leaking during an occurrence of misfire of the engine 31, makes contact with the catalyst 31*b* and ignites.

Figure 5:
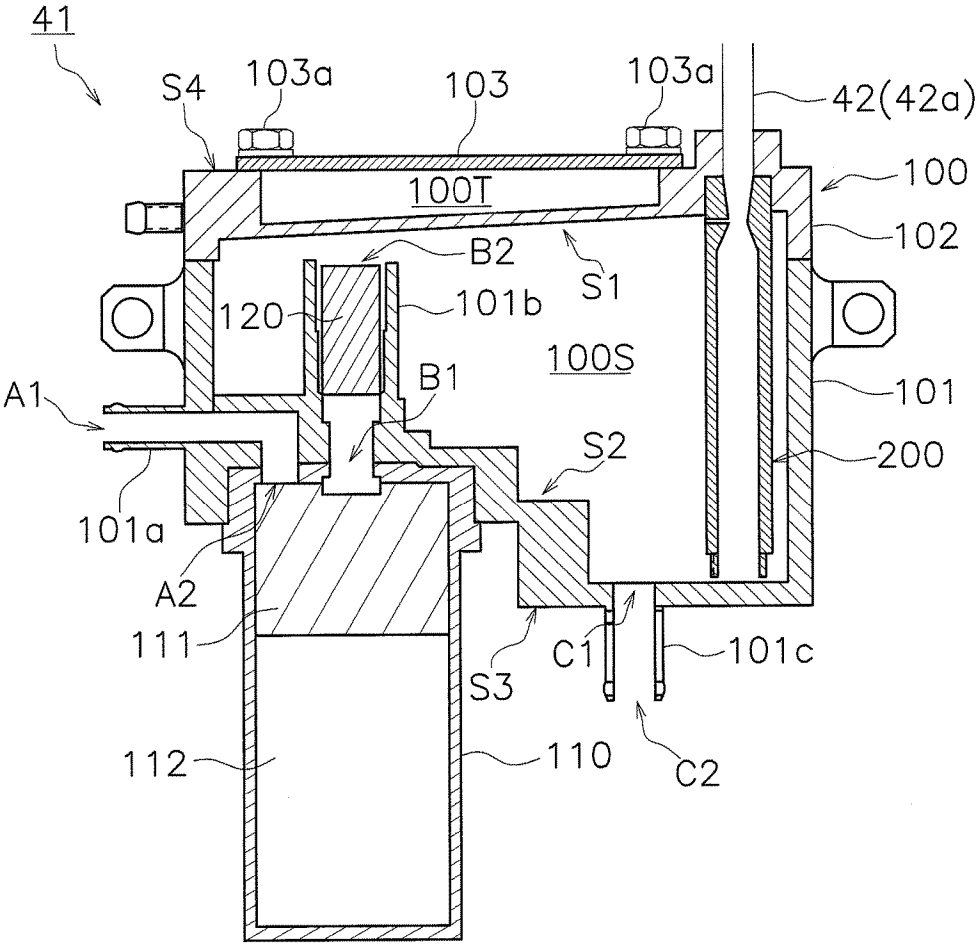
FIG. 5 is a cross-sectional view of an internal structure of a fuel tank.

Next, a structure of the fuel tank 41 will be explained. FIG. 5 is a cross-sectional view of an internal structure of the fuel tank 41.

The fuel tank 41 includes a chassis 100, a filtration filter 110, and a strainer 120.

The chassis 100 includes the fuel storage region 100S, a coolant path 100T, a lower case 101, an upper case 102, and a cover 103.

The fuel storage region 100S is defined by a space between the lower case 101 and the upper case 102. Adhesion between the lower case 101 and the upper case 102 reliably achieves liquid tight properties and gas tight properties of the fuel storage region 100S. The liquid fuel and the vaporized fuel are both stored in the fuel storage region 100S.

The vaporized-liquid fuel mixture suction portion 200 of the fuel path 42 is fixed to a top surface S1 of the fuel storage region 100S. The height of the top surface S1 preferably gradually increases toward the vaporized-liquid fuel mixture suction portion 200. It is thus possible to reduce the volume of a portion of the fuel storage region 100S occupied by the vaporized fuel. In other words, it is possible to increase the amount of the liquid fuel stored in the fuel storage region 100S. In the present preferred embodiment, the vaporized-liquid fuel mixture suction portion 200 is disposed at an end of the fuel storage region 100S. Thus, the height of the top surface S1 increases from one end of the top surface S1 to the other end thereof. However, the structure of the top surface S1 is not limited to this. For example, when the vaporized-liquid fuel mixture suction portion 200 is disposed in the middle of the fuel storage region 100S, it is only required to set the height of the middle portion of the top surface S1 to be higher than that of the outer peripheral portion thereof. Further, the top surface S1 is only required to have a height gradually increasing toward the vaporized-liquid fuel mixture suction portion 200. Thus, the top surface S1 may have a planar shape as shown in FIG. 5, or alternatively, may have a stepped shape.

The height of a bottom surface S2 of the fuel storage region 100S preferably decreases toward the vaporized-liquid fuel mixture suction portion 200. In the present preferred embodiment, the vaporized-liquid fuel mixture suction portion 200 is disposed at the end of the fuel storage region 100S. Thus, the height of the bottom surface S2 decreases from one end of the bottom surface S2 to the other end thereof. However, the structure of the bottom surface S2 is not limited to this. For example, when the vaporized-liquid fuel mixture suction portion 200 is disposed in the middle of the fuel storage region 100S, it is only required to set the height of the middle portion of the bottom surface S2 to be lower than that of the outer peripheral portion thereof. Further, the bottom surface S2 is only required to have a height gradually decreasing toward the vaporized-liquid fuel mixture suction portion 200. Thus, the bottom surface S2 may have a stepped shape as shown in FIG. 5, or alternatively may have a planar shape.

The coolant path 100T is defined by a space between the upper case 102 and the cover 103. The coolant path 100T is a sealed region configured to circulate a coolant therethrough. Adhesion between the upper case 102 and the cover 103 reliably achieves liquid tight properties of the coolant path 100T. The coolant path 100T is located above the fuel storage region 100S. The vaporized fuel is cooled down within the fuel storage region 100S by the circulation of the coolant through the coolant path 100T.

The lower case 101 preferably has the shape of a cup. The lower case 101 is made by a material made of resin, metal or so forth. The lower case 101 includes a connector 101*a*, a fuel inflow pipe 101*b*, and a drain 101*c*.

The tip of the fuel supply pipe 39 is connected to the connector 101*a*. The connector 101*a* includes an inlet port A1 and an outlet port A2. The fuel flows into the inlet port A1 from the fuel supply pipe 39 and flows out of the outlet port A2 to the filtration filter 110.

The fuel inflow pipe 101*b* protrudes from the bottom surface S2 of the fuel storage region 100S. The fuel inflow pipe 101*b* extends in the up-and-down direction within the fuel storage region 100S. The fuel inflow pipe 101*b* includes an inlet port B1 and an outlet port B2. The inlet port B1 is provided in a lower surface S3 of the lower case 101. The outlet port B2 is provided in the upper end of the fuel inflow pipe 101*b*. The fuel flows into the inlet port B1 from the filtration filter 110 and flows out of the outlet port B2 to the fuel storage region 100S. The fuel inflow pipe 101*b* defines a wall to reliably store a required amount of the liquid fuel in the fuel storage region 100S.

The drain 101*c* is connected to the lower surface S3 of the lower case 101. The drain 101*c* includes an inlet port C1 and an outlet port C2. The inlet port C1 is provided in the bottom surface S2 of the fuel storage region 100S. The outlet port C2 is provided in the lower end of the fuel inflow pipe 101*b*.

The upper case 102 is disposed on the lower case 101. The upper case 102 is fixed to the lower case 101 so as to be adhered to each other. The sealed space between the lower case 101 and the upper case 102 defines the fuel storage region 100S. The upper case 102 includes a recess on an upper surface S4 thereof, and the recess defines a portion of the coolant path 100T. The lower surface of the upper case 102 defines the top surface S1 of the fuel storage region 100S.

The cover 103 covers the recess on the upper surface S4 of the upper case 102. The cover 103 is fixed to the upper case 102 by fixtures 103*a* so as to be adhered thereto. The sealed space between the upper case 102 and the cover 103 defines a portion of the coolant path 100T.

The filtration filter 110 is attached to the lower surface S3 of the lower case 101. The filtration filter 110 is connected to the lower end of the fuel inflow pipe 101*b*. The filtration filter 110 accommodates a paper filter 111 and a water separation filter 112. The paper filter 111 removes foreign objects from the fuel flowing through the connector 101*a*. The water separation filter 112 separates water mixed into the fuel passing through the paper filter 111. The fuel, passing through the water separation filter 112, flows into the inlet port B1 of the fuel inflow pipe 101*b*.

The strainer 120 is disposed inside the fuel inflow pipe 101*b*. The strainer 120 removes foreign objects from the fuel passing through the water separation filter 112. The fuel, passing through the strainer 120, flows into the fuel storage region 100S through the outlet port B2 of the fuel inflow pipe 101*b*.

Figure 6:
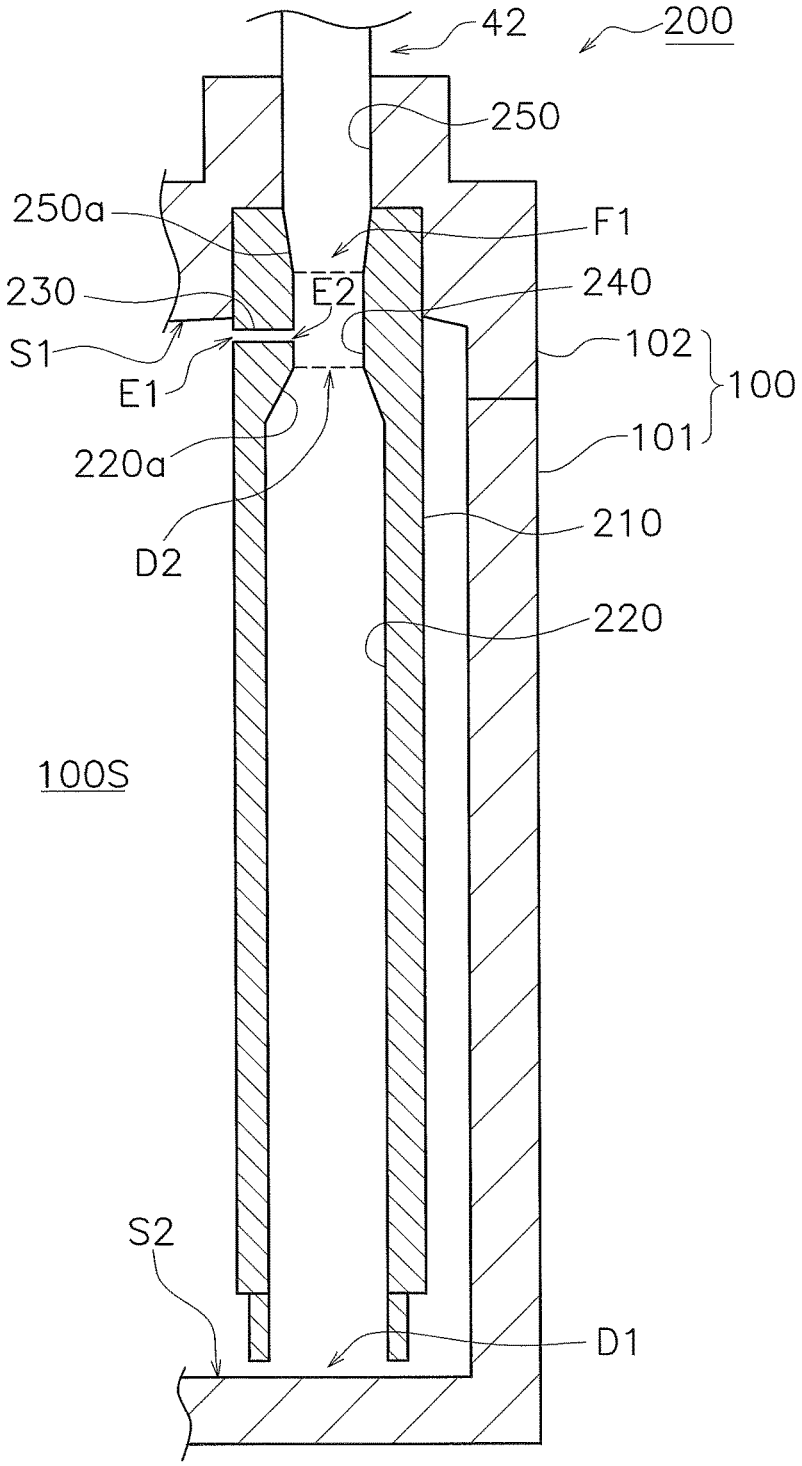
FIG. 6 is a cross-sectional view of a vaporized-liquid fuel mixture suction portion.

Next, a structure of the vaporized-liquid fuel mixture suction portion 200 will be explained. FIG. 6 is a cross-sectional view of the vaporized-liquid fuel mixture suction portion 200.

The vaporized-liquid fuel mixture suction portion 200 includes a body 210, a liquid fuel path 220, a vaporized fuel path 230, a venturi path 240, and a vaporized-liquid fuel mixture path 250.

The body 210 preferably has a rod shape. The body 210 is preferably made of a material including resin, metal or so forth. The liquid fuel path 220, the vaporized fuel path 230, the venturi path 240, and the vaporized-liquid fuel mixture path 250 are provided in the interior of the body 210.

The liquid fuel path 220 is connected to the upstream side of the venturi path 240. The liquid fuel path 220 includes a liquid fuel suction port D1 and a liquid fuel discharge port D2. The liquid fuel suction port D1 is located at an end of the body 210. The liquid fuel suction port D1 is located in the lower end of the fuel storage region 100S. In the present preferred embodiment, the liquid fuel suction port D1 is opposed to the bottom surface S2 of the fuel storage region 100S. The liquid fuel discharge port D2 is located on the opposite side of the liquid fuel suction port D1. The liquid fuel discharge port D2 is provided in the entrance of the venturi path 240. Thus, the liquid fuel path 220 communicates with the fuel storage region 100S and the venturi path 240. During normal operation, the liquid fuel suction port D1 is constantly submerged in the liquid fuel. Thus, the liquid fuel is sucked into the liquid fuel suction port D1 and is discharged out of the liquid fuel discharge port D2.

The liquid fuel path 220 includes a constricted portion 220*a* connected to the venturi path 240. The constricted portion 220*a* tapers toward the venturi path 240. Thus, the inner diameter of the constricted portion 220*a* gradually decreases toward the venturi path 240. The flow rate of the liquid fuel flowing through the liquid fuel path 220 increases in the constricted portion 220*a*.

The vaporized fuel path 230 is connected to a lateral side of the venturi path 240. The vaporized fuel path 230 includes a vaporized fuel suction port E1 and a vaporized fuel discharge port E2. The vaporized fuel suction port E1 is located in the lateral surface of the body 210. The vaporized fuel suction port E1 is located higher than the liquid fuel suction port D1 of the liquid fuel path 220. The vaporized fuel suction port E1 is located in the upper end of the fuel storage region 100S. The vaporized fuel suction port E1 is located below the highest portion of the top surface S1 of the fuel storage region 100S. The vaporized fuel discharge port E2 is provided in the lateral surface of the venturi path 240. Thus, the vaporized fuel path 230 communicates with the fuel storage region 100S and the venturi path 240. The vaporized fuel suction port E1 is exposed above the liquid fuel, and thus, the vaporized fuel is sucked into the vaporized fuel suction port E1 and is discharged from the vaporized fuel discharge port E2. It should be noted that the vaporized fuel suction port E1 has a possibility of being temporarily submerged into the liquid fuel. In this case, the liquid fuel is sucked into the vaporized fuel suction port E1 and is discharged from the vaporized fuel discharge port E2.

The venturi path 240 is connected to the downstream side of the liquid fuel path 220. The venturi path 240 is defined by a partial constriction in the fuel path 42. The liquid fuel is discharged into the venturi path 240 from the liquid fuel discharge port D2 of the liquid fuel path 220. The flow rate of the fuel flowing through the venturi path 240 is greater than that of the liquid fuel flowing through the liquid fuel path 220. Thus, negative pressure is produced in the venturi path 240 due to the venturi effect. Accordingly, the vaporized fuel is discharged from the vaporized fuel discharge port E2 into the venturi path 240. Thus, the vaporized fuel mixes with the liquid fuel, and the vaporized-liquid fuel mixture is produced within the venturi path 240.

The vaporized-liquid fuel mixture path 250 is connected to the downstream side of the venturi path 240. The vaporized-liquid fuel mixture path 250 includes a vaporized-liquid fuel mixture suction port F1. The vaporized-liquid fuel mixture suction port F1 is located at the exit of the venturi path 240. The vaporized-liquid fuel mixture produced within the venturi path 240 is sucked into the vaporized-liquid fuel mixture path 250 through the vaporized-liquid fuel mixture suction port F1. The vaporized-liquid fuel mixture, sucked into the vaporized-liquid fuel mixture path 250 through the vaporized-liquid fuel mixture suction port F1, flows toward the fuel pump 43.

The vaporized-liquid fuel mixture path 250 includes an expanded portion 250*a* connected to the venturi path 240. The expanded portion 250*a* tapers toward the venturi path 240. The inner diameter of the expanded portion 250*a* gradually increases in a direction opposite to the venturi path 240. The flow rate of the fuel flowing through the vaporized-liquid fuel mixture path 250 decreases in the expanded portion 250*a*.

Next, the cross-sectional areas of the respective paths and the opening areas of the respective openings will be explained. In the following explanation, the term "cross-sectional area" indicates the area of a cross-section orthogonal to the center axis of each path.

The cross-sectional area of the liquid fuel path 220 gradually decreases in the constricted portion 220*a*. The cross-sectional area of the vaporized fuel path 230 is preferably constant. The cross-sectional area of the venturi path 240 is preferably constant. The cross-sectional area of the vaporized-liquid fuel mixture path 250 gradually increases in the expanded portion 250*a*. The cross-sectional area of the vaporized fuel path 230 is smaller than that of the venturi path 240. The cross-sectional area of the vaporized fuel path 230 is smaller than the minimum cross-sectional area of the liquid fuel path 220 and that of the vaporized-liquid fuel mixture path 250. The cross-sectional area of the venturi path 240 is preferably equivalent to the minimum cross-sectional area of the liquid fuel path 220 and that of the vaporized-liquid fuel mixture path 250.

The opening area of the liquid fuel suction port D1 is larger than that of the liquid fuel discharge port D2. The opening area of the liquid fuel discharge port D2 is preferably equivalent to that of the vaporized-liquid fuel mixture suction port F1. The opening area of the vaporized fuel suction port E1 is preferably equivalent to that of the vaporized fuel discharge port E2. The opening area of the vaporized fuel suction port E1, as well as that of the vaporized fuel discharge port E2, is smaller than that of the liquid fuel suction port D1, that of the liquid fuel discharge port D2, and that of the vaporized-liquid fuel mixture suction port F1. The opening area of the vaporized fuel suction port E1, as well as that of the vaporized fuel discharge port E2, is set to be approximately 4%, for example, of that of the venturi path 240.

Next, conditions of the liquid fuel and flows of the vaporized fuel will be explained. FIGS. 7 to 11 are schematic diagrams for explaining the conditions of the liquid fuel and the flows of the vaporized fuel in the fuel tank 41 on a time-series basis. In each of FIGS. 7 to 11, the condition of the liquid fuel is depicted with hatching, whereas the flow of the vaporized fuel is depicted with arrows.

Figure 7:
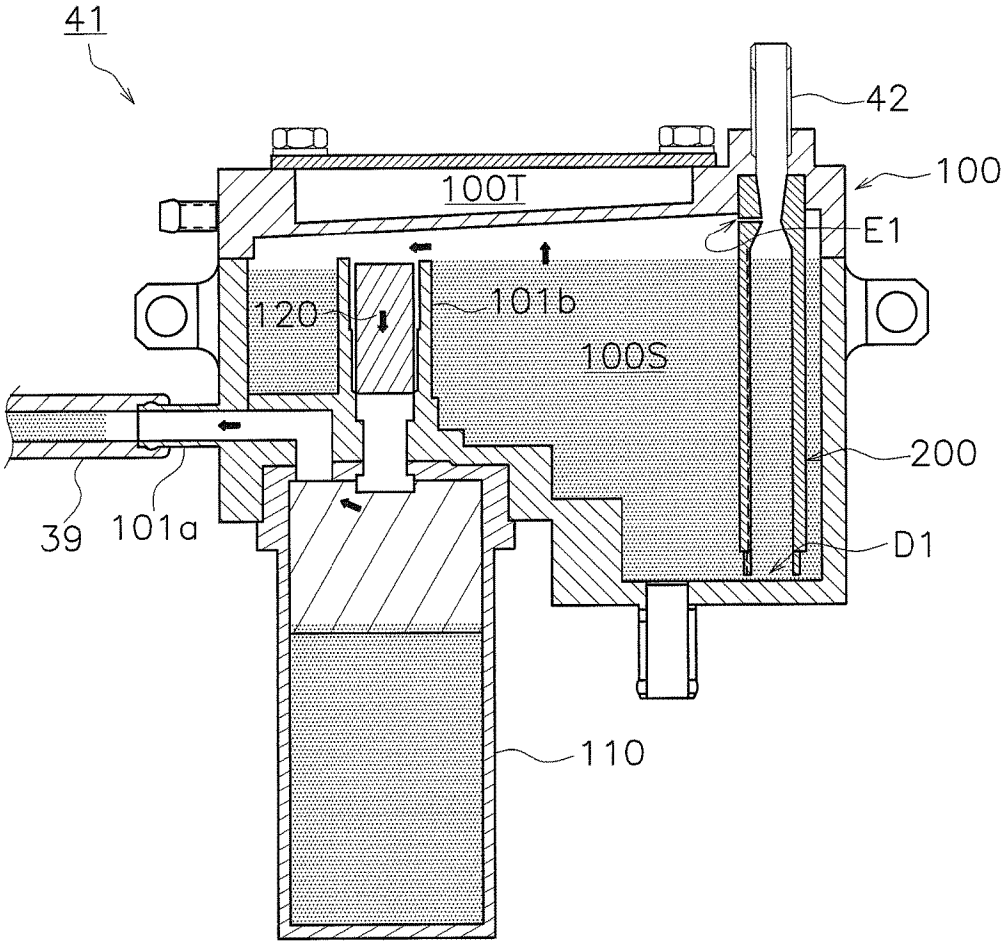
FIG. 7 is a schematic diagram for explaining a condition of a fuel in a liquid state and a flow of a fuel in a gaseous state inside the fuel tank on a time-series basis.

First, as shown in FIG. 7, when the engine is stopped, the fuel inside the filtration filter 110 and the strainer 120 is pushed back to the interior of the fuel supply pipe 39 by the pressure of the vaporized fuel produced in the fuel storage region 100S.

Figure 8:
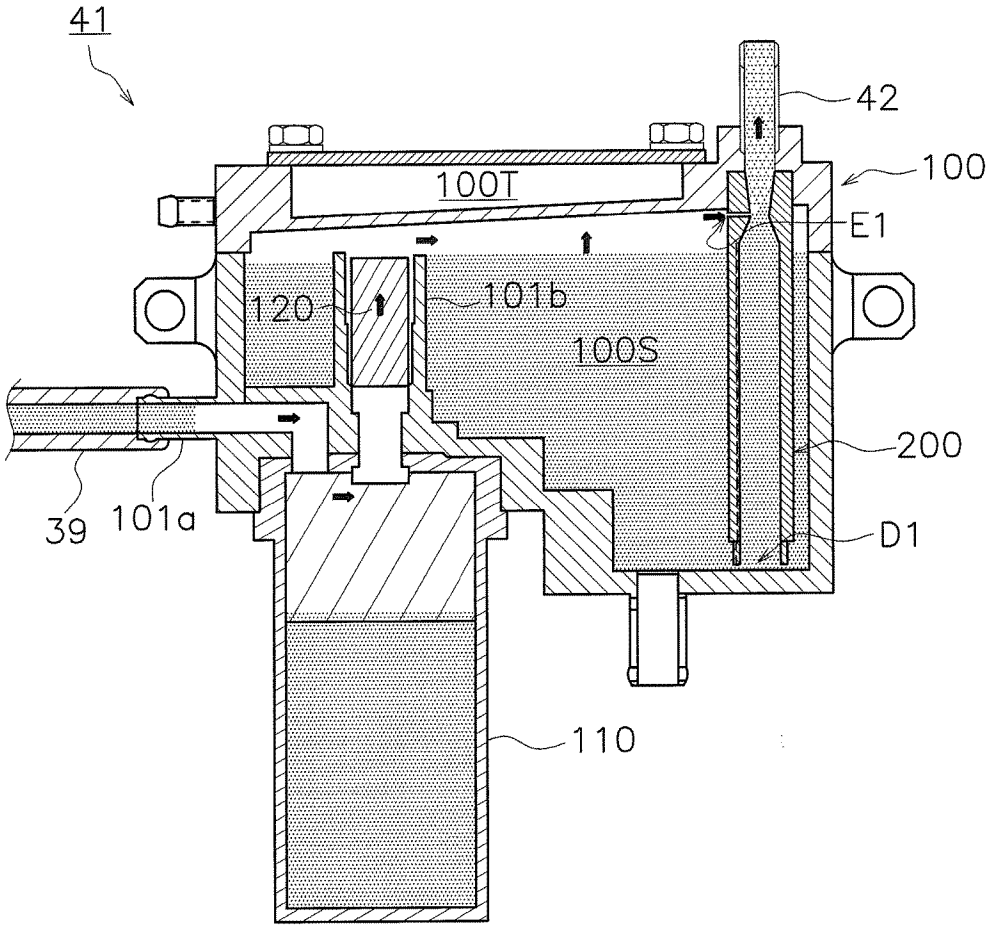
FIG. 8 is a schematic diagram for explaining a condition of the fuel in the liquid state and a flow of the fuel in the gaseous state inside the fuel tank on a time-series basis.

Next, as shown in FIG. 8, when the engine is started, the vaporized fuel and the liquid fuel are sucked through the vaporized-liquid fuel mixture suction portion 200, and the vaporized-liquid fuel mixture is produced inside the vaporized-liquid fuel mixture suction portion 200. At this time, the vaporized fuel inside the fuel supply pipe 39 is sucked into the fuel storage region 100S. The vaporized fuel sucked into the fuel storage region 100S is cooled down by the coolant circulating through the coolant path 100T.

Figure 9:
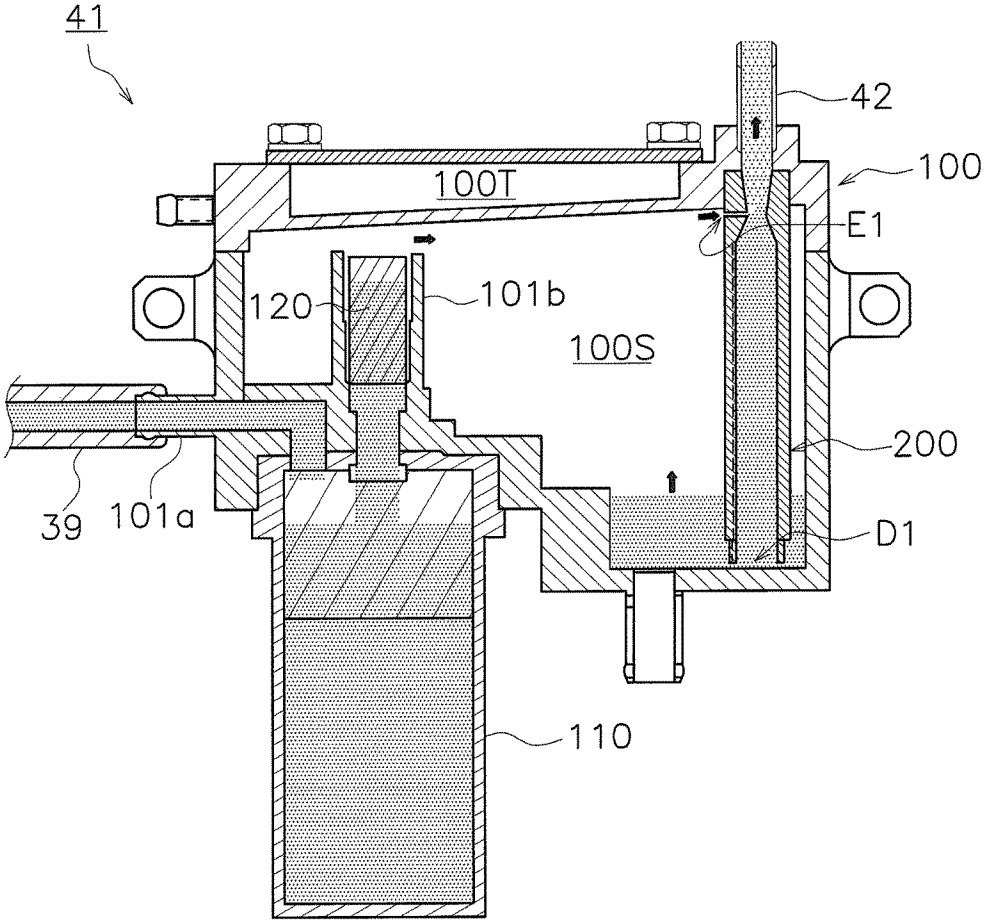
FIG. 9 is a schematic diagram for explaining a condition of the fuel in the liquid state and a flow of the fuel in the gaseous state inside the fuel tank on a time-series basis.

Next, as shown in FIG. 9, when the throttle valve is fully opened, the vaporized-liquid fuel mixture is successively sucked through the vaporized-liquid fuel mixture suction portion 200, and the amount of the fuel decreases in the fuel storage region 100S.

Figure 10:
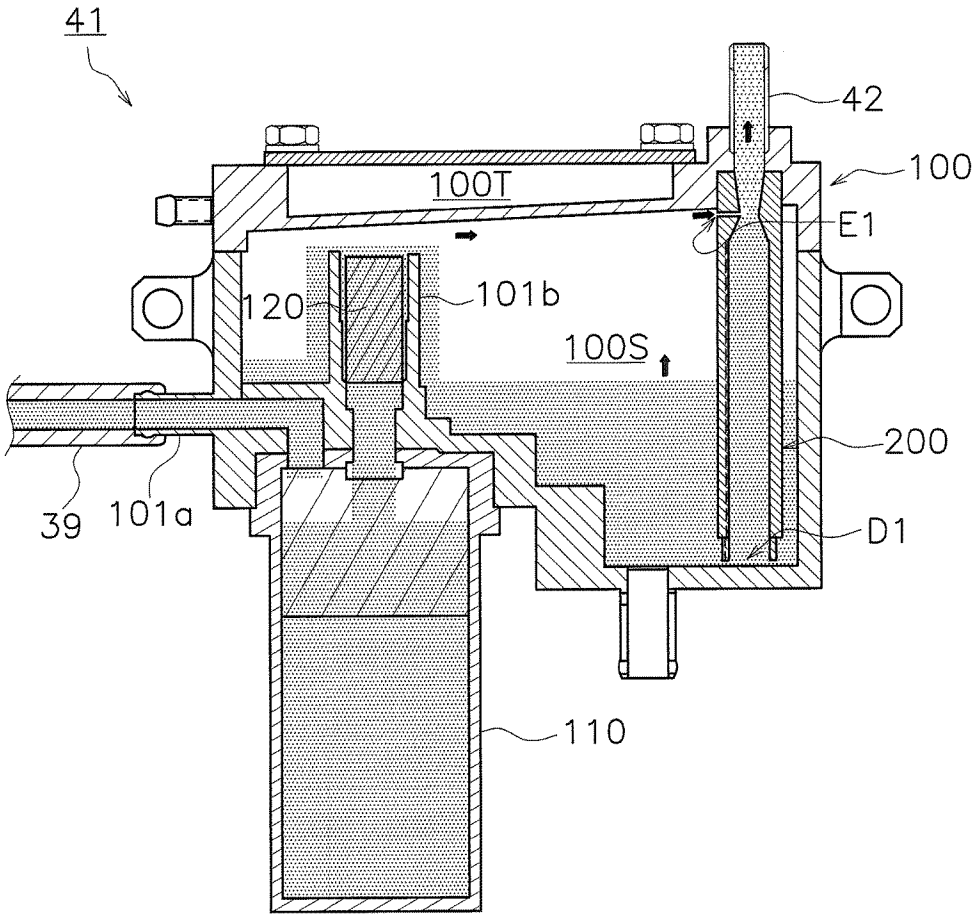
FIG. 10 is a schematic diagram for explaining a condition of the fuel in the liquid state and a flow of the fuel in the gaseous state inside the fuel tank on a time-series basis.

Next, as shown in FIG. 10, after a period of time since full opening of the throttle valve, the liquid fuel that has been pushed back to the interior of the fuel pipe 39 is sucked into the fuel storage region 100S in accordance with a decrease in the amount of the fuel in the fuel storage region 100S. At this time, the liquid fuel to be sucked into the fuel storage region 100S is filtered by the filtration filter 110 and the strainer 120.

Figure 11:
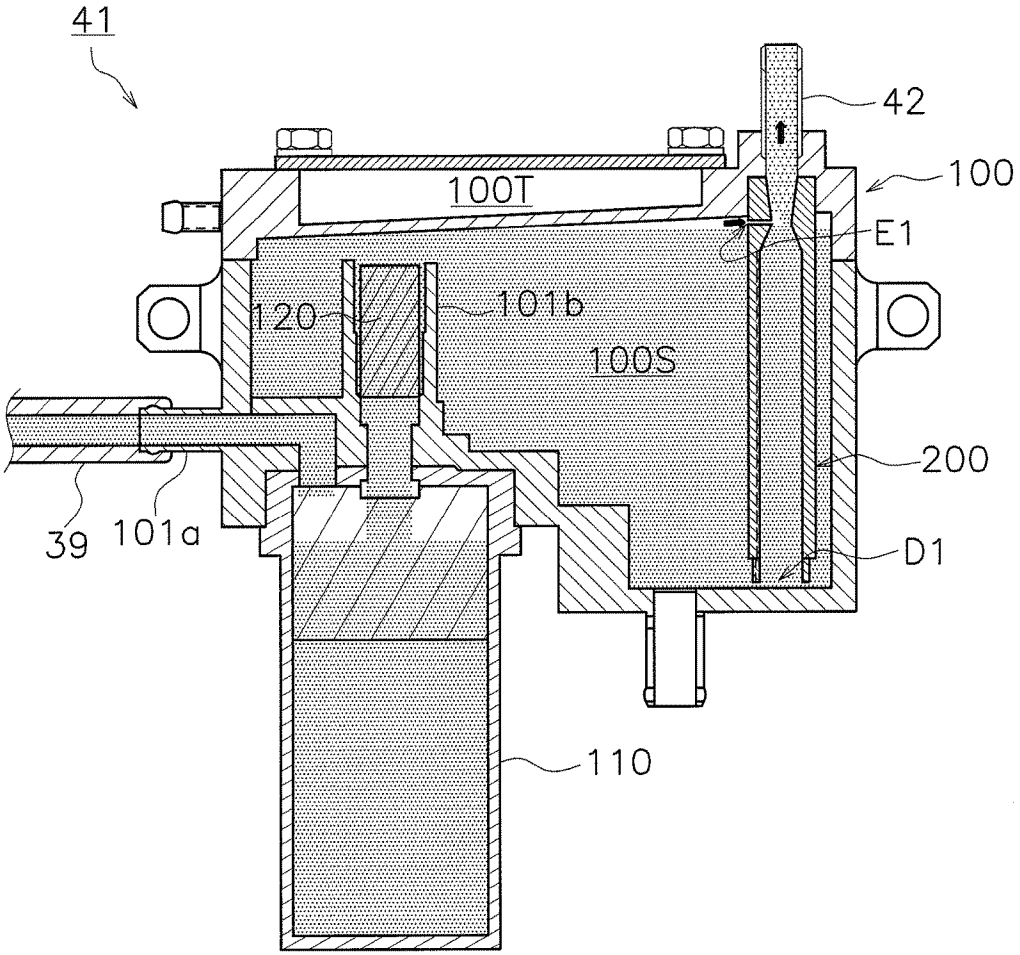
FIG. 11 is a schematic diagram for explaining a condition of the fuel in the liquid state and a flow of the fuel in the gaseous state inside the fuel tank on a time-series basis.

Next, as shown in FIG. 11, when full opening of the throttle valve is continued, the fuel storage region 100S is filled with the liquid fuel in accordance with consecutive suction of the vaporized-liquid fuel mixture through the vaporized-liquid fuel mixture suction portion 200. At this time, the vaporized fuel is constantly produced from the liquid fuel. The produced vaporized fuel is sucked through the vaporized fuel suction port E1.

The vaporized-liquid fuel mixture, sucked through the vaporized-liquid fuel mixture suction portion 200, is liquefied by compression of the fuel pump 43, and is then supplied to the fuel injection device 42*f* (see FIG. 2).

As described above, the fuel supply device 40 according to the present preferred embodiment includes the fuel tank 41, the fuel path 42, and the fuel pump 43. The fuel tank 41 includes the fuel storage region 100S as a sealed region. The fuel path 42 includes the liquid fuel suction port D1, the vaporized fuel suction port E1, and the vaporized-liquid fuel mixture suction port F1. The vaporized fuel within the fuel storage region 100S is sucked through the vaporized fuel suction port E1. The liquid fuel within the fuel storage region 100S is sucked through the liquid fuel suction port D1. The vaporized-liquid fuel mixture, produced when the vaporized fuel sucked through the vaporized fuel suction port E1 mixes into the liquid fuel sucked through the liquid fuel suction port D1, is sucked through the vaporized-liquid fuel mixture suction port F1. The vaporized-liquid fuel mixture is compressed by the fuel pump 43 to a discharge pressure greater than or equal to a pressure at which the vaporized fuel liquefies.

As described above, in the fuel supply device 40 according to the present preferred embodiment, the vaporized fuel contained in the vaporized-liquid fuel mixture is liquefied by the fuel pump 43. Hence, the vaporized fuel within the fuel storage region 100S is actively consumed as a portion of the fuel, and production of the vaporized fuel from the liquid fuel supplied to the engine 31 is inhibited. As a result, it is not required to provide a mechanism to discharge the vaporized fuel produced in the fuel storage region 100S and/or the fuel path 42. Thus, degradation in the discharge performance of the fuel pump 43 is inhibited with a simple structure.

Second Preferred Embodiment

Figure 12:
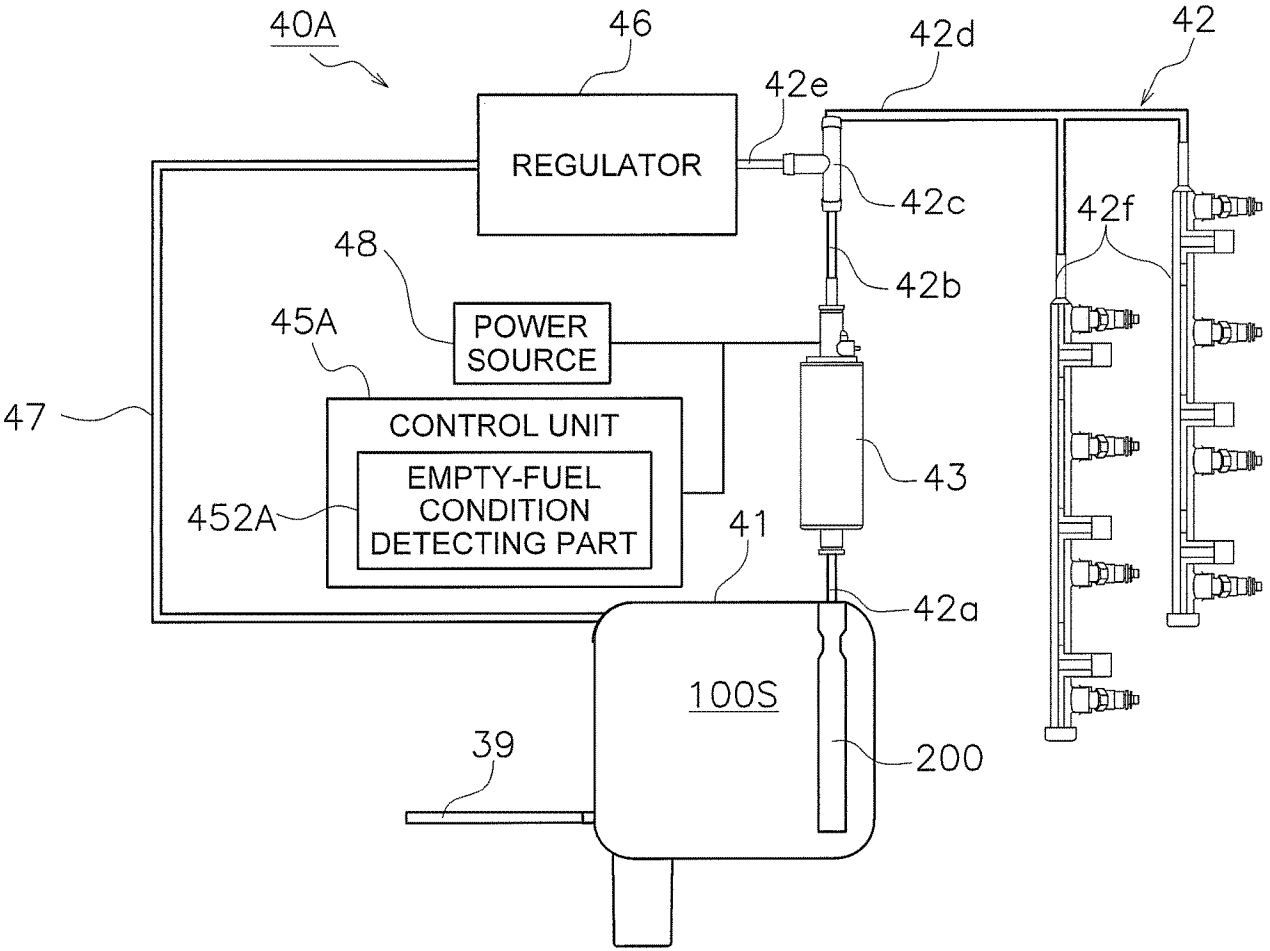
FIG. 12 is a schematic diagram of a structure of a fuel supply device according to a second preferred embodiment of the present invention.

FIG. 12 is a schematic diagram of a structure of a fuel supply device 40A according to a second preferred embodiment of the present invention. The fuel supply device 40A is different from the fuel supply device 40 according to the first preferred embodiment in that the empty-fuel condition control is performed based on a current value to be supplied to the fuel pump 43. The difference will be mainly hereinafter explained.

The fuel supply device 40A includes a regulator 46, a return path 47, a power source 48, and a controller 45A. The regulator 46 is connected to the fuel path 42 (the fourth fuel hose 42*e*). The regulator 46 is configured to regulate the pressure of the fuel discharged from the fuel pump 43 to a target value by releasing or diverting a surplus fuel existing in the fuel path 42 to the return path 47.

The return path 47 is connected to the fuel tank 41 and the regulator 46. The fuel released from the regulator 46 returns to the fuel tank 41 through the return path 47.

The power source 48 is configured to drive the fuel pump 43 by supplying current to the fuel pump 43. A solenoid pump, for example, is preferably used as the fuel pump 43, and driving control thereof is enabled by varying the current value. The power source 48 is configured to supply current in accordance with the load on the fuel pump 43 (i.e., a torque to rotate the fuel pump 43). When the load of the fuel pump 43 varies, the current value to be supplied to the fuel pump 43 from the power source 48 increases or decreases. For example, when the storage amount in the fuel storage region 100S decreases and accordingly the ratio of the vaporized fuel contained in the vaporized-liquid fuel mixture to be sucked into the fuel pump 43 increases, the load on the fuel pump 43 decreases and the current value to be supplied to the fuel pump 43 from the power source 48 decreases.

The controller 45A is configured and/or programmed to include an empty-fuel condition detector 452A.

Figure 13:
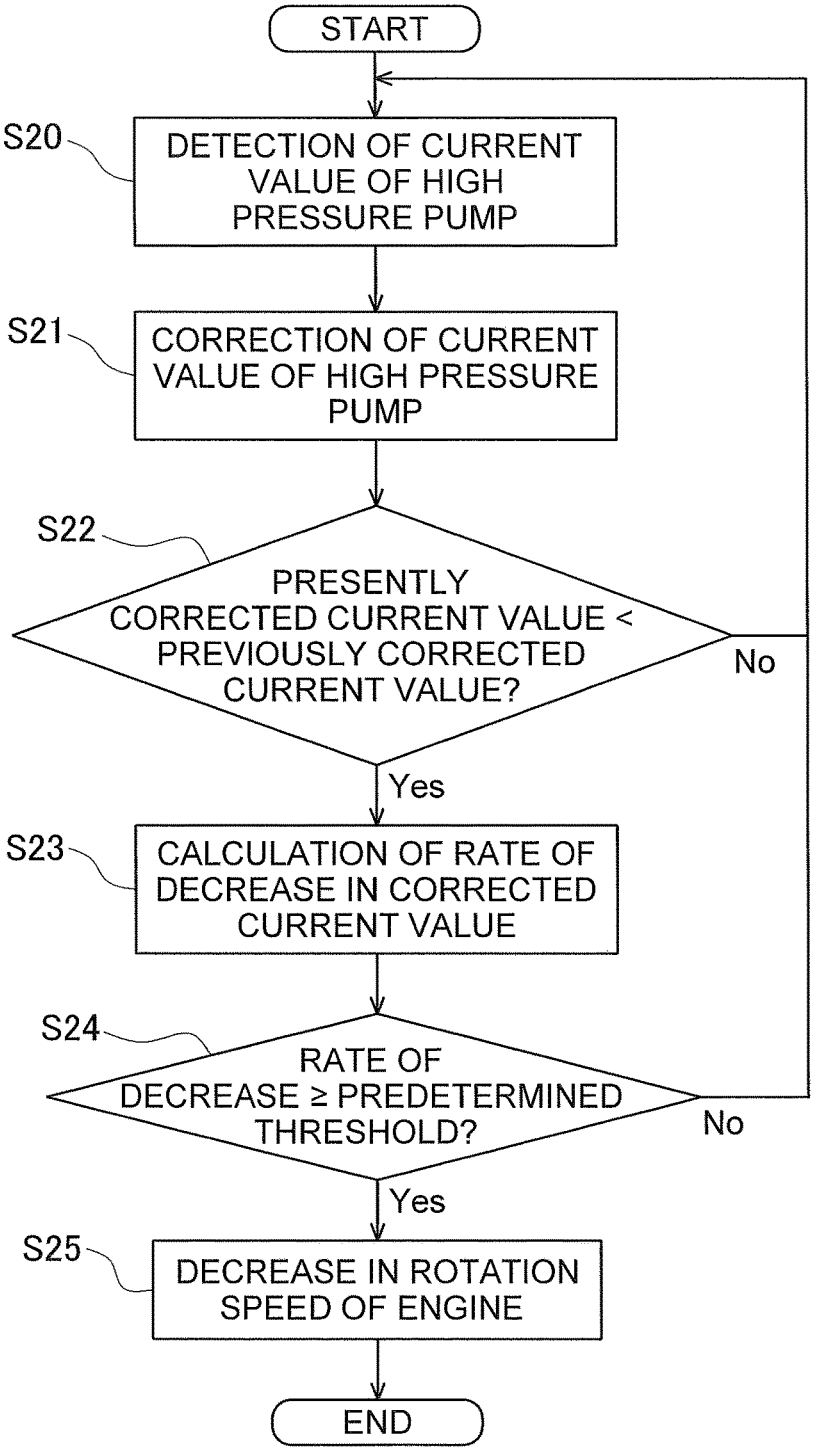
FIG. 13 is a flowchart for explaining an empty-fuel condition control according to the second preferred embodiment of the present invention.

The empty-fuel condition detector 452A is configured to perform an empty-fuel condition control of detecting a fuel shortage in the fuel tank 41 and decreasing the rotation speed of the engine 31. FIG. 13 is a flowchart for explaining the empty-fuel condition control to be performed by the empty-fuel condition detector 452A.

First in Step S20, the empty-fuel condition detector 452A detects a current value to be supplied to the fuel pump 43 from the power source 48. Next in Step S21, the empty-fuel condition detector 452A calculates a corrected current value by correcting the current value based on a variation in voltage of the power source 48, variation in fuel temperature, or variation in fuel flow rate. It is possible to accurately observe a variation in current value in accordance with an increase or reduction in the storage amount in the fuel storage region 100S by thus cancelling out the increase or decrease in current value in accordance with a variation in power source voltage, variation in fuel temperature, or variation in fuel flow rate.

Next in Step S22, the empty-fuel condition detector 452A determines whether or not the corrected current value calculated presently is less than that calculated previously. The fact that the corrected current value calculated presently is less than that calculated previously indicates that there is a possibility of a decrease in the amount of the fuel stored in the fuel storage region 100S. When the empty-fuel condition detector 452A determines that the corrected current value calculated presently is less than that calculated previously, the process proceeds to Step S23, and otherwise, returns to Step S20.

Next in Step S23, the empty-fuel condition detector 452A calculates a rate of decrease in the corrected current value by differentiating a differential obtained by subtracting the corrected current value calculated presently from that calculated previously. The rate of decrease in the corrected current value is a rate of decrease in current value per unit time.

Next in Step S24, the empty-fuel condition detector 452A determines whether or not the rate of decrease in the corrected current value is greater than or equal to a predetermined threshold. During this process, the empty-fuel condition detector 452A determines whether or not the storage amount in the fuel storage region 100S has become a predetermined remaining amount or less, i.e., whether or not an empty-fuel condition has occurred. When determining that the rate of decrease is greater than or equal to the predetermined threshold, the empty-fuel condition detector 452A determines that the empty-fuel condition has occurred. Accordingly, the process proceeds to Step S25. The predetermined remaining amount is only required to be set to an amount that enables the engine 31 to be driven until the temperature of the catalyst 31*b* decreases and becomes less than the ignition temperature of the fuel. When determining that the rate of decrease is less than the predetermined threshold, the empty-fuel condition detector 452A determines that the empty-fuel condition has not occurred. Accordingly, the process returns to Step S20.

Next, in Step S25, the empty-fuel condition detector 452A decreases the rotation speed of the engine 31 in order to decrease the temperature of the catalyst 31*b* accommodated in the exhaust pipe 31*a*.

As described above, the empty-fuel condition control is performed based on the current value to be supplied to the fuel pump 43. Hence, it is not required to provide a device exclusively to detect the empty-fuel condition (e.g., a fuel pressure sensor). Thus, fuel shortage is detected with a simple structure. Further, it is possible to decrease the temperature of the catalyst 31*b* to be less than the ignition temperature of the fuel by the aforementioned empty-fuel condition control. It is thus possible to inhibit occurrence of a situation that the fuel, leaking during an occurrence of misfire of the engine 31, makes contact with the catalyst 31*b* and ignites.

Other Preferred Embodiments

In the aforementioned first preferred embodiment, the empty-fuel condition detector 452 is preferably configured to use the duty ratio corrected based on the power source voltage, the fuel temperature, or the fuel flow rate in the empty-fuel condition control. However, an uncorrected duty ratio may be used in the empty-fuel condition control.

In the aforementioned first preferred embodiment, the empty-fuel condition detector 452 is preferably configured to detect a fuel shortage when the rate of increase in duty ratio of the fuel pump 43 becomes greater than or equal to the predetermined threshold. However, the configuration of detecting a fuel shortage is not limited to this. The empty-fuel condition detector 452 may be configured to detect a fuel shortage when the amount of fuel discharged from the fuel pump 43 becomes less than or equal to a predetermined threshold or when the duty ratio of the fuel pump 43 itself becomes greater than or equal to a predetermined threshold.

In the aforementioned second preferred embodiment, the empty-fuel condition detector 452A is preferably configured to use the current value (i.e., load) corrected based on the power source voltage, the fuel temperature, or the fuel flow rate in the empty-fuel condition control. However, an uncorrected current value may be used in the empty-fuel condition control.

In the aforementioned second preferred embodiment, the empty-fuel condition detector 452A is preferably configured to detect a fuel shortage when the rate of decrease in current value becomes greater than or equal to the predetermined threshold. The configuration of detecting fuel shortage is not limited to this. The empty-fuel condition detector 452A may be configured to detect fuel shortage when the current value (i.e., load) to be supplied to the fuel pump 43 becomes less than or equal to a predetermined threshold.

In the aforementioned preferred embodiments, the fuel path 42 preferably is designed to include the single liquid fuel suction port D1, but alternatively, may include a plurality of the liquid fuel suction ports D1. Likewise, the fuel path 42 is designed to include the single vaporized fuel suction port E1, but alternatively, may include a plurality of the vaporized fuel suction ports E1.

In the aforementioned preferred embodiments, the fuel path 42 preferably is designed to extend from the upper surface of the fuel tank 41, but alternatively, may extend from either the lateral surface or the lower surface of the fuel tank 41.

In the aforementioned preferred embodiments, the fuel pump 43 preferably is designed to be disposed outside the fuel tank 41, but alternatively, may be disposed inside the fuel tank 41.

In the aforementioned preferred embodiments, the vaporized-liquid fuel mixture suction port F1 preferably is designed to be disposed within the fuel storage region 100S, but alternatively, may be disposed outside the fuel tank 41.

In the aforementioned preferred embodiments, the fuel tank 41 preferably is designed to be directly connected to the outside tank 22 of the hull 20. However, a sub tank may be disposed between the fuel tank 41 and the outside tank 22. The sub tank may have a capacity larger than that of the fuel tank 41.

In the aforementioned preferred embodiments, the fuel tank 41 preferably is designed to include the filtration filter 110 (including the paper filter 111 and the water separation filter 112) and the strainer 120, but alternatively, may not include at least one of these components. Further or alternatively, the fuel tank 41 may include another type of filter on an as-needed basis.

In the aforementioned preferred embodiments, the fuel tank 41 preferably is designed to include the coolant path 100T located above the fuel storage region 100S, but alternatively, may not include the coolant path 100T.

In the aforementioned preferred embodiments, the coolant path 100T of the fuel tank 41 preferably is designed to be located above the fuel storage region 100S, but alternatively, may be located laterally to the fuel storage region 100S.

The fuel supply device 40 may include a drawing pump disposed between the vaporized-liquid fuel mixture suction portion 200 and the fuel pump 43 in the fuel path 42. A general positive displacement pump is preferably used as the drawing pump.

The fuel supply device 40 may include a drawing pump disposed between the fuel pump 43 and the fuel injection device 42*f*. A general positive displacement pump is preferably used as the drawing pump.

The fuel supply device 40 may include a drawing pump disposed between the fuel tank 41 and the outside tank 22. Drawing of the fuel to the fuel tank 41 and an increase in pressure is simultaneously performed by the drawing pump. A general low pressure pump or a manual pump is preferably used as the drawing pump.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A boat propulsion device comprising:

an engine including a fuel injection device;

a fuel tank including a fuel storage region configured to store fuel;

a fuel path connected to the fuel injection device and the fuel tank;

a fuel pump disposed in the fuel path and configured to discharge the fuel stored in the fuel storage region to the fuel injection device; and a controller configured and/or programmed to control a load on the fuel pump; wherein the controller is configured and/or programmed to include an empty-fuel condition detector configured to detect that the fuel stored in the fuel storage region has become a predetermined remaining amount or less based on a variation in the load on the fuel pump.

2. The boat propulsion device according to claim 1, wherein the fuel storage region is a sealed region.

3. The boat propulsion device according to claim 1, wherein the fuel path includes a liquid fuel suction port and a vaporized fuel suction port which are located within the fuel storage region.

4. The boat propulsion device according to claim 1, further comprising:

a return path connected to the fuel path and the fuel tank and configured to return a surplus amount of the fuel discharged from the fuel pump to the fuel storage region; wherein the empty-fuel condition detector is configured to detect that the fuel stored in the fuel storage region has become the predetermined remaining amount or less when the load on the fuel pump has become a predetermined threshold or less.

5. The boat propulsion device according to claim 1, further comprising:

a return path connected to the fuel path and the fuel tank and configured to return a surplus amount of the fuel discharged from the fuel pump to the fuel storage region; wherein the empty-fuel condition detector is configured to detect that the fuel stored in the fuel storage region has become the predetermined remaining amount or less when a rate of decrease in the load on the fuel pump has become a predetermined threshold or greater.

6. The boat propulsion device according to claim 1, further comprising:

a fuel pressure sensor configured to detect a pressure of the fuel discharged from the fuel pump; wherein the controller is configured and/or programmed to control the load on the fuel pump based on a detection value of the fuel pressure sensor.

7. The boat propulsion device according to claim 6, wherein the empty-fuel condition detector is configured to detect that the fuel stored in the fuel storage region has become the predetermined remaining amount or less when an amount of the fuel discharged from the fuel pump has become a predetermined threshold or less.

8. The boat propulsion device according to claim 6, wherein the empty-fuel condition detector is configured to detect that the fuel stored in the fuel storage region has become the predetermined remaining amount or less when the load on the fuel pump has become a predetermined threshold or greater.

9. The boat propulsion device according to claim 6, wherein the empty-fuel condition detector is configured to detect that the fuel stored in the fuel storage region has become the predetermined remaining amount or less when a rate of increase in the load on the fuel pump has become a predetermined threshold or greater.

* * * * *